US006238224B1

(12) United States Patent
Shao

(10) Patent No.: US 6,238,224 B1
(45) Date of Patent: May 29, 2001

(54) SAFETY STRUCTURE IN A SOCKET

(76) Inventor: Hung-Chiang Shao, No. 59-2, Sec. 3, Pa Te Rd., Pan Chiao City, Taipei (TW)

( * ) Notice: Subject to any disclaimer, the term of this patent is extended or adjusted under 35 U.S.C. 154(b) by 0 days.

(21) Appl. No.: 09/452,950

(22) Filed: Dec. 2, 1999

(51) Int. Cl.[7] ..... H01R 13/44
(52) U.S. Cl. ..... 439/137
(58) Field of Search ..... 439/137, 143, 439/145

(56) References Cited

U.S. PATENT DOCUMENTS 4,867,694 * 9/1989 Short ..... 439/137

* cited by examiner

*Primary Examiner*—Hien Vu
*Assistant Examiner*—Shanetta D. Ore
(74) *Attorney, Agent, or Firm*—Varndell & Varndell, PLLC

(57) ABSTRACT

Safety Structure in a Socket, especially a design of safety feature in a socket capable of preventing risks of electric shock due to erroneous insertion of dangerous foreign materials into socket holes; comprising: one insert hole canopy, two detents, two resilient members and a support, the detent being a U shaped sheet having one tilt shield on one side on the surface, with its ramp side tilted inwardly, while the other side constitutes a detent block, both detents arranged tight mounted in said canopy by symmetry, what with a resilient member hinged into the rear side of both tilt shields, a support holds said both detents in position, assembled to completion.

3 Claims, 5 Drawing Sheets

SAFETY STRUCTURE IN A SOCKET

BACKGROUND OF THE INVENTION (a) Field of the Invention

Safety structure in a socket, more specifically, one such that inside the insert hole lid are provided two detent elements which must be pushed altogether by the two legs of a plug being plugged into the socket assembly to yield so that the conductor is accessed to supply power, while insertion with respect to a single insert hole instead of two is bound to be blocked, so that safety is assured.

(b) Description of the Prior Art

Conventionally, the conductor of a socket is attached close inside each insert hole to facilitate accessing to power supply once put into contact with the legs of a plug being applied into the socket, while such a design is convenient enough, the absence of a suitable separation way between the insert holes and the conductor may prove something involving a safety concern, for naughty kids may, out of curiosity, insert foreign material into the insert holes, and that might give occasion to electric shock, all the more so in the case of extension sockets, being movable, it can be laid on the ground within easy reach of young kids, and where the kids are not under adult's direct supervision, electric shock due to insertion of foreign material into said insert holes of a conventional socket, fixed or movable, can happen anytime and anywhere.

SUMMARY OF THE INVENTION

The primary object of the invention, therefore, is to provide a design for safety feature in a socket, comprising essentially two detent elements inside the insert hole lid capable of moving reversely, on the rear side of these two detents is provided a resilient member which will yield if and only if a plug with its two legs were being applied by insertion straight into the hole lids simultaneously, whereupon the detents are undone, allowing the incoming plug legs to find their way in contact with the conductor in the socket, and power is accessed, but when only one of the two insert holes is being challenged by an incoming foreign material applied by a naughty kid, the displacement on the part of the detent is such that the incoming foreign material is blocked off the conductor all the same, and the purpose of preventing innocent kids from getting injured due to naughty acts which could otherwise incur electric shock, is served.

DETAILED DESCRIPTION OF THE PREFERRED EMBODIMENTS

Figure 1:
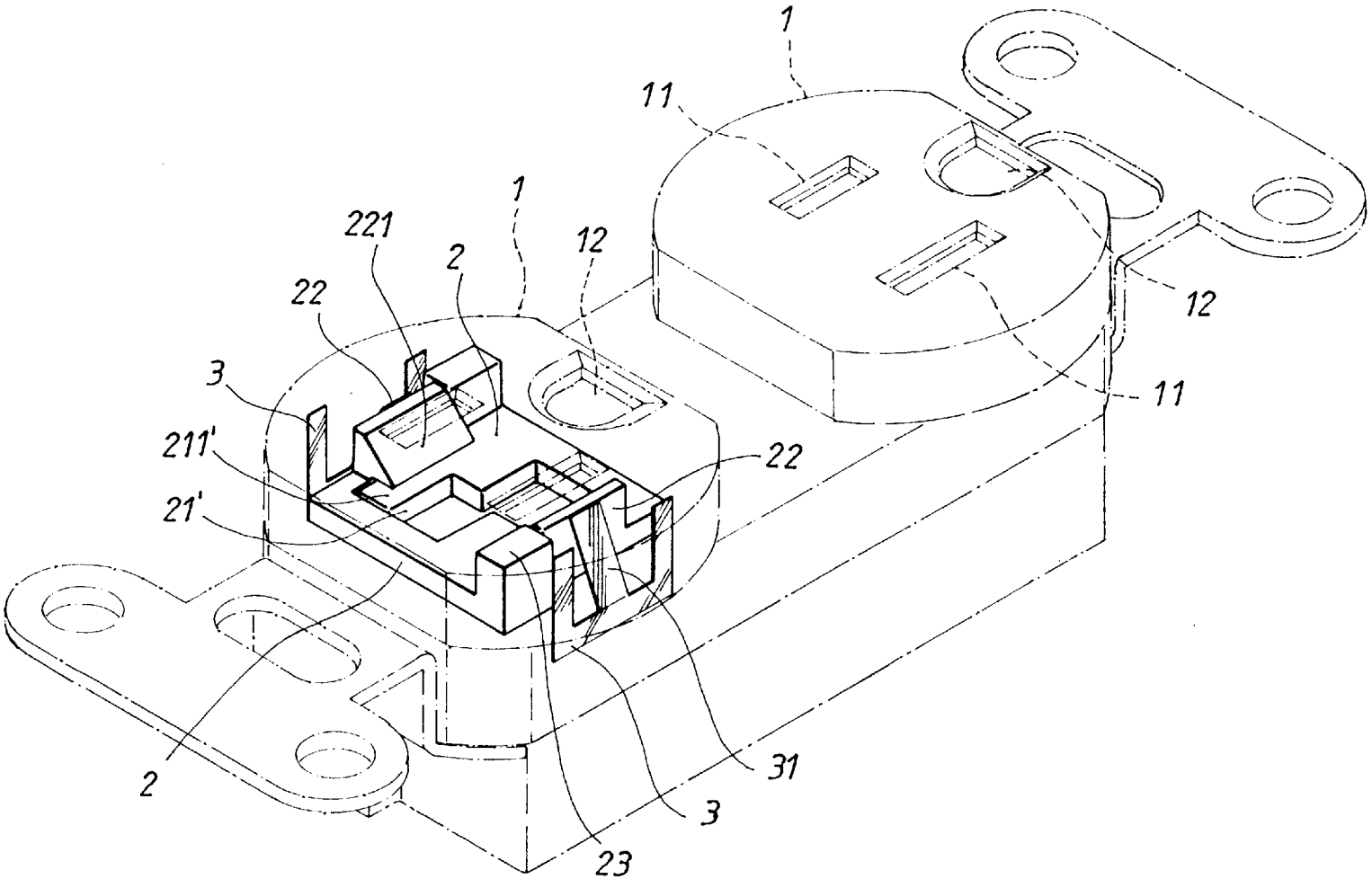
FIG. 1 is a three-dimensional perspective of the invention accomplished of assemblage.
Figure 2:
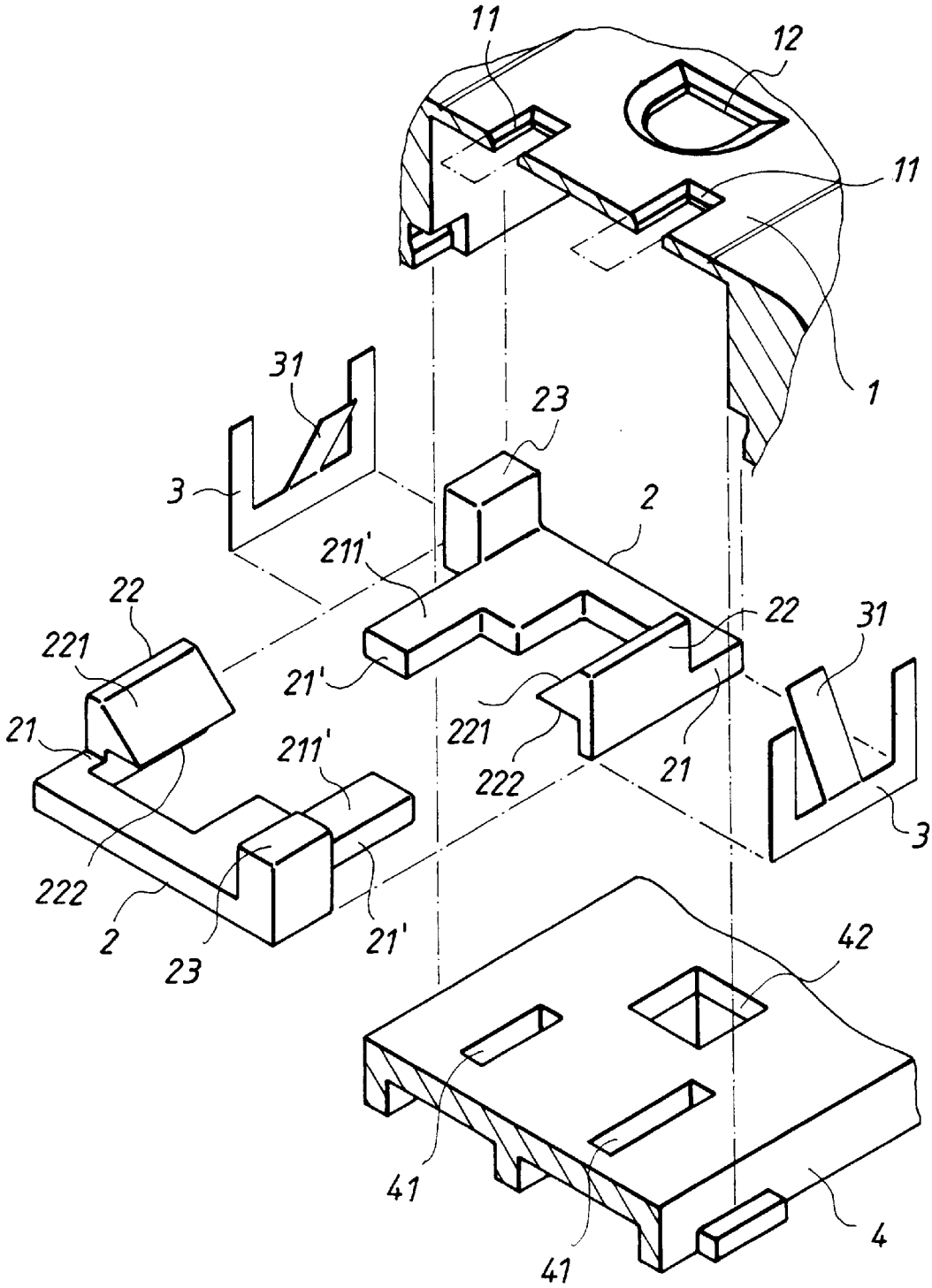
FIG. 2 is an exploded analytical view of the invention.
Figure 3:
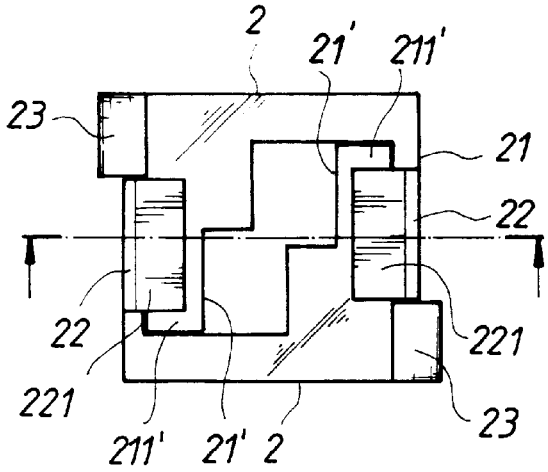
FIG. 3 is a top view of the twin detent assembly according to the invention.
Figure 4:
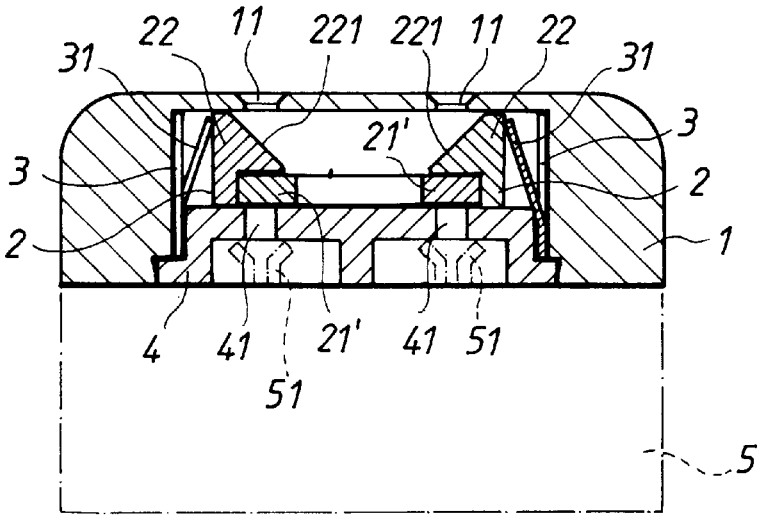
FIG. 4 is a section view of the invention accomplished of assemblage.
Figure 5:
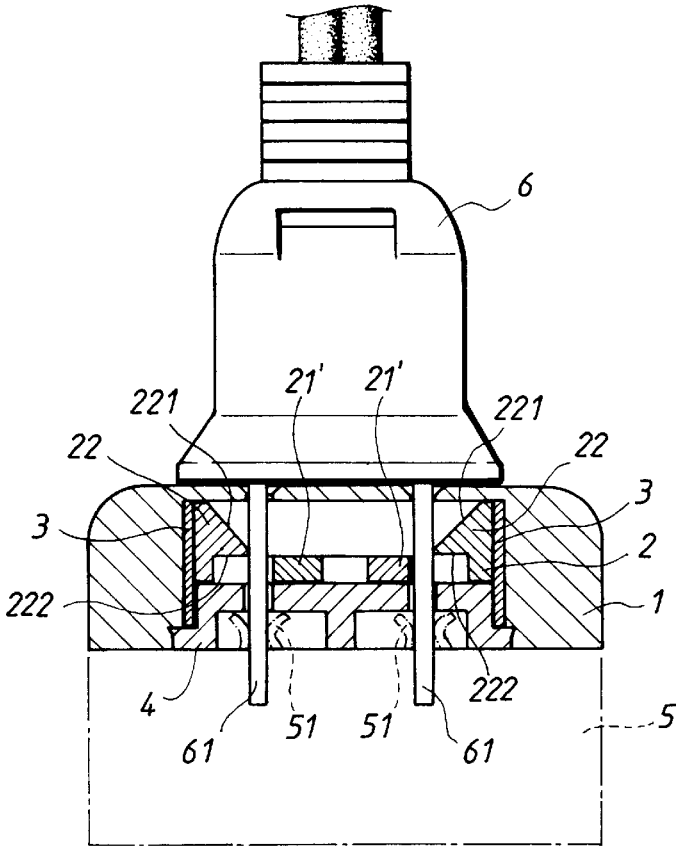
FIG. 5 is an illustration of the invention active in operation.

As shown in FIG. 1 and FIG. 2, the invention design of safety structure in a socket comprises essentially: an insert hole lid 1, two detent elements 2, two resilient members 3 and a support 4; whereof:

The insert hole lid 1, executed to be capable of guiding incoming plug legs to access power supply, is configured largely dependent upon the overall structure of the socket, rather than being of a fixed profile, on the surface are provided insert holes 11, one accommodating to a positive incoming plug leg, the other a negative one, or alternatively optionally a grounding hole 12 may be provided suitably elsewhere on the same surface;

The detent element 2, comprising two extension arms 21, 21', each taking the profile of the letter U, and on the surface of one extension arm 21 is formed a shield 22 whose ramp 221 bears inwardly and whose frontal tip projects juttingly inside the extension arm 21 so as to form a plane wedge 222 on the bottom of the shield 22, while the surface of another extension arm 21' is formed to be a detent 211' part, on one side of the external wall of the extension arm 21' is formed a shield 23, substantially rectanguloid, thus accounting for a detent member 2;

The resilient member 3, being a flexible piece, roughly resembles the letter U, and has a protruding reed 31 formed centrally inside;

The support 4, a board in support of the detent element 2, has insert hole 11 responding to insert hole lid 1 and passage holes 41, 42 concentric with the grounding insert hole 12, to facilitate passage by the pair of legs on the part of an incoming plug;

For assemblage, said two detents 2 are brought to engagement against correspondent contours, as illustrated in FIG. 3, with the ramps 221 on the shields 22 confronting each other, so that the detent tips 211' on the part of each detent 2 is detained by the wedge 222 on the bottom of the tilted shield 22, so that both detents 2 may react to dislodge outwards, the two detents 2 are installed in the insert hole lid 1, such as is shown in FIG. 1, and FIG. 4, so that their respective tilted shields 22 are positioned beneath the insert hole 11, the rear side of said tilted shields 22, as part of the detent 2, is each hingedly fitted with a resilient member 3 so that its reed 31 is brought to abut against the hinder side of the shield 22, so that both shields 22 are constantly depressed down the insert hole 11, with the support 4 mounted beneath the insert hole lid 1, support is rendered to both detents 2 and both resilient members 3 to make the safety structure of a socket, once integrated to the chassis of a regular socket 5, so that the conductor 51 rests just below the passage holes 41, 42 on the support 4, there accomplishes the assemblage of a safety socket.

The basic rationale of the invention is to prevent electric shock when the socket is being challenged with a foreign material applied by innocent kids or otherwise by inadvertency, referring to FIG. 4, it will be appreciated that in normal usage conditions, when a plug 6 by its two legs 61 is inserted straight into the insert holes 11 on the insert hole lid 1, the effort will in the meantime bear upon the ramps 221 on the tilted shield 22 that is part of the detents 2, the design of the ramp 221 is such that as both of the incoming legs 61 continue to bear downwardly, the two detents 2 will be pushed to dislodge laterally on both sides, so that the extension arms 21' down the shield 22 are compelled to shift in like measure inwards, eventually making room to a space to accommodate passage of both legs 61, the passage will thence pass the passage hole 41 on the support 4, into contact with the conductor 51, and power supply is accessed thereby, since in normal usage conditions the user will usually hold the plug 6 all right free and clear of any safety concerns.

Figure 6:
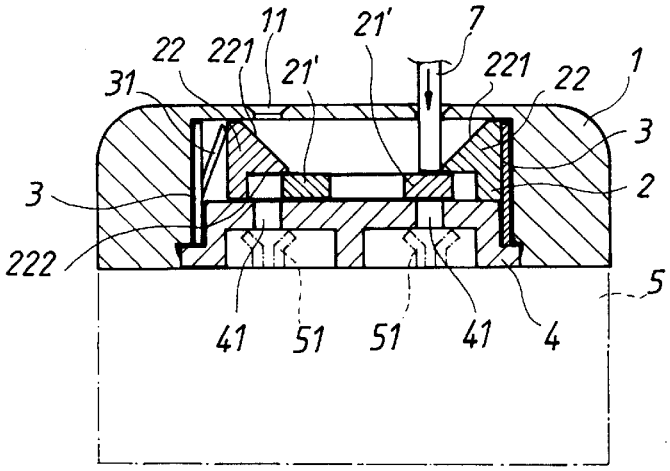
FIG. 6 is an illustration of the invention being challenged for a purpose other than power accessing; and, FIG. 7 is a three-dimensional perspective of the invention executed in a variant embodiment.

Under otherwise conditions, however, any unwanted inroads, by filaments or nail, or else, will be blocked by aforementioned two detents 2, such as is shown in FIG. 6, for when somebody wilfully or a naughty kid, holding one foreign material 7, applies same into insert hole 11 on the cover 1, and hits all right one of the detent 2, while the detent 2 being acted upon, by the outward dislodgement of its shield 22, may yield somewhat to result in the intruding foreign material 7 gaining in, however minimal, that the other detent 2 did not give in to back somehow at the same time will translate for its extension arm 21' maintaining still its position beneath the shield 22 having thus been dislodged somewhat; that is, the intruding foreign material 7 gets blocked by the detent 211' that is part of the extension arm 21', denied all chances of further progression, and of contact with the conductor 51, no current transmitted to the incoming foreign material 7, and the naughty kid or other inadvertent user is thereby safeguarded from electric shock.

The disclosure going thus far should suffice to justify the desirability of the invention in that it can reliably prevent electric shock otherwise possibly materialized due to incorrect use of a socket, the detents 2 present beneath said insert hole lid 1 serves additionally to prevent dust build-up in the conductor 51 to ensure better conduction performance as an added advantage.

Figure 7:
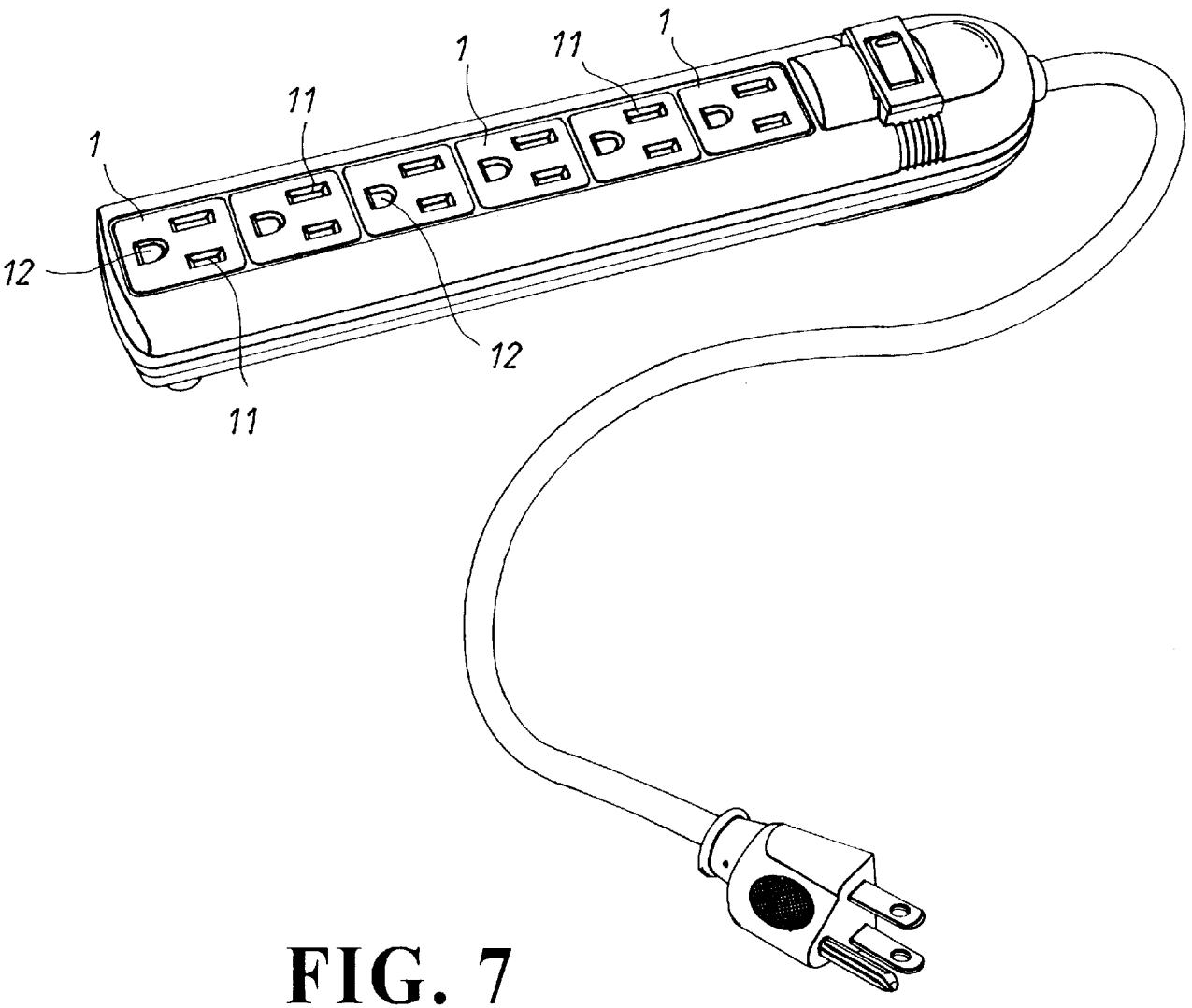

Moreover, execution of the invention is not limited merely to the fixed type of sockets immobilized onto walifoot, instead it will find just equally effective application in movable socket utilities such as extension sockets, as illustrated in FIG. 7, on regular two-hole models as well as on three-hole models without any restriction.

What is claimed is:

1. A safety structure for an electrical socket, which comprises an insert hole lid, first and second detents, and two resilient members;

the insert hole lid covering the electrical socket and having a structure matching that of the electrical socket, the insert hole lid having a top including two holes;

the first and second detents respectively having a U-shape where legs of the U-shape form first and second extension arms, a tilt shield extending upward from a surface of the first extension arm, the tilt shield having a tilted side sloping inwardly and terminating in a frontal tip, a bottom of the tilt shield of the first detent fitting over a top surface of the second extension arm of the second detent, a bottom of the tilt shield of the second detent fitting over a top surface of the second extension arm of the first detent; the first and second detents being arranged below the insertion hole lid, so that the tilt shields of the first and second detents are respectively range beneath the two insert holes of the insert hole lid; and the resilient members being elastomeric pieces having a W-shape, a center leg of the W-shape forming a reed extending inwardly at an angle, the resilient members being arranged adjacent back sides of the tilt shields of the first and second detents, and the reeds of the resilient members respectively biasing the tilt shields of the first and second detents inwardly so that the tilt shields are constantly maintained in a position below the insert holes of the insert hole lid, thereby making a safety structure.

2. The safety structure for an electrical socket as defined in claim 1, wherein the insert hole lid includes a grounding hole.

3. The safety structure for an electrical socket as defined in claim 2, wherein a supporting means is provided internally on a bottom of said insert hole lid, a surface of the supporting means having passage holes corresponding to the insert holes and the grounding hole of the insert hole lid.

* * * * *